United States Patent [19]

Lawrence

[11] 4,235,435

[45] Nov. 25, 1980

[54] SHEET SORTER

[75] Inventor: Frederick J. Lawrence, San Francisco, Calif.

[73] Assignee: Stewart & Shea, Newport, Calif.

[21] Appl. No.: 936,724

[22] Filed: Aug. 25, 1978

[51] Int. Cl.[3] ..... B65H 29/58; B65H 31/24

[52] U.S. Cl. ..... 271/292; 271/197; 271/297

[58] Field of Search ..... 271/173, 64, 197, 297, 271/305, 292; 209/657; 270/58

[56] References Cited

U.S. PATENT DOCUMENTS 3,937,459 2/1976 Lawrence ..... 271/173

3,988,018 10/1976 Tusso et al. ..... 271/173

4,124,204 11/1978 Van Buskirk ..... 271/173

*Primary Examiner*—Bruce H. Stoner, Jr.

*Attorney, Agent, or Firm*—Newton H. Lee, Jr.

[57] ABSTRACT

A sorting machine has sheet deflecting fingers actuatable from closed positions at one side of a sheet path to open positions, in succession, to remove sheets from a sheet transport and direct the sheets into trays. The fingers, in closed condition, span adjacent fingers, in nested relation, with surfaces of the fingers facing the transport lying on a plane parallel to the moving sheets and extending arcuately beneath the open finger below to assist in guiding a sheet into a tray.

13 Claims, 6 Drawing Figures

SHEET SORTER

BACKGROUND OF THE INVENTION

In my prior U.S. Pat. No. 3,937,459, granted Feb. 10, 1976, there is disclosed a sorting machine for use with copying machines, wherein a sheet transport carries successive sheets in a path extending past a set of pivotal fingers, which are of a nesting construction, and which, when open, provide curved surfaces engageable by an advancing sheet, to pick the sheet off of the transport and direct the sheet into a tray or receiver. The nesting of the fingers provides a smooth guide for the sheet, so that if the sheet tends to curl or flutter off of the transport, the sheet is confined by the guide which is in close proximity and parallel to the transport.

Such a structure has been found to be very efficient for sorting sheets of paper of a range of weights in a sorter structure which can be applied to a variety of copying machines, or in large sheet sorting equipment. However, the incorporation of sheet sorting apparatus in copying machines has resulted in a trend towards designs requiring smaller sorters capable of sorting a large number, say twenty copies of a given original.

SUMMARY OF THE INVENTION

The present invention relates to improved sorting mechanism of the type generally disclosed in the aforementioned patent, namely, the nesting finger type, which can be substantially smaller in its over-all proportions, particularly in terms of the spacing of the bins or receivers for the sorted sheets, due to the compact construction of the sheet deflecting finger assembly.

In accomplishing the foregoing, the invention contemplates a finger structure which is sufficiently long to enable it to have the desired or necessary arched sheet engaging surface, of sufficiently large radius, as to deflect a sheet gradually through an angle of approximately 90°, but yet the dimension of the apparatus, in the direction of sheet travel, is maintained quite small. To this end, the fingers not only nest, but, also, the fingers span adjacent finger supports or bodies.

More particularly, the fingers on a given pivot support or body nest with the fingers of the next adjacent pivot support or body, bridge such next adjacent pivot support or body, and extend substantially to a location adjacent to the pivot support or body of the second adjacent fingers, whereby the fingers have the necessary length to provide thereon the desired arc on the sheet engaging surface, as well as the necessary movement of the finger tip to pick a sheet from the transport.

The invention also contemplates that, since the fingers are sequentially operable to deflect or pick sheets from the transport, and since the fingers bridge adjacent finger supports, the provision of an oeprating mode, wherein an adjacent pair of finger supports or bodies are actuated to cause opening of both of said pair of fingers, so that the interference of one set of fingers with sheet deflection by the other set of fingers of the adjacent pair is eliminated. This is to say that, since the fingers of each set bridge or nest within the fingers of the adjacent set, so that the fingertips of one set would interfere with the functioning of the adjacent set to deflect and guide a sheet, the interfering set of fingers is also opened to remove the finger tips from the path of travel of the sheet of paper.

With these desired functions in mind, the fingers of one set are laterally offset with respect to the fingers of the next adjacent set, but can be aligned, longitudinally, with the fingers of the second adjacent set. Thus, the finger sets are made up of pairs of rock shafts with fingers thereon spaced laterally of the shafts so that the fingers on adjacent pairs of shafts or bodies can longitudinally overlap or nest, but the fingers can be longitudinally aligned with the fingers of the shaft or body second removed.

In its preferred form, illustrated and described herein, the invention involves combining the finger assembly and transport assembly in a housing structure which can be easily opened or separated between the transport and finger sub-assemblies, the transport, being the usual endless belt transport, wherein air pressure maintains the sheets in friction drive relation to the endless belts, and the fingers are adapted, upon opening, to extend, past the plane of the sheet supporting belt surfaces to strip the sheets from the belts and deflect the sheets into the bins or receiver trays. Such a construction simplifies clearing a jammed sheet at the transport-finger interface.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

DESCRIPTION OF THE PREFERRED EMBODIMENT

Figure 1:
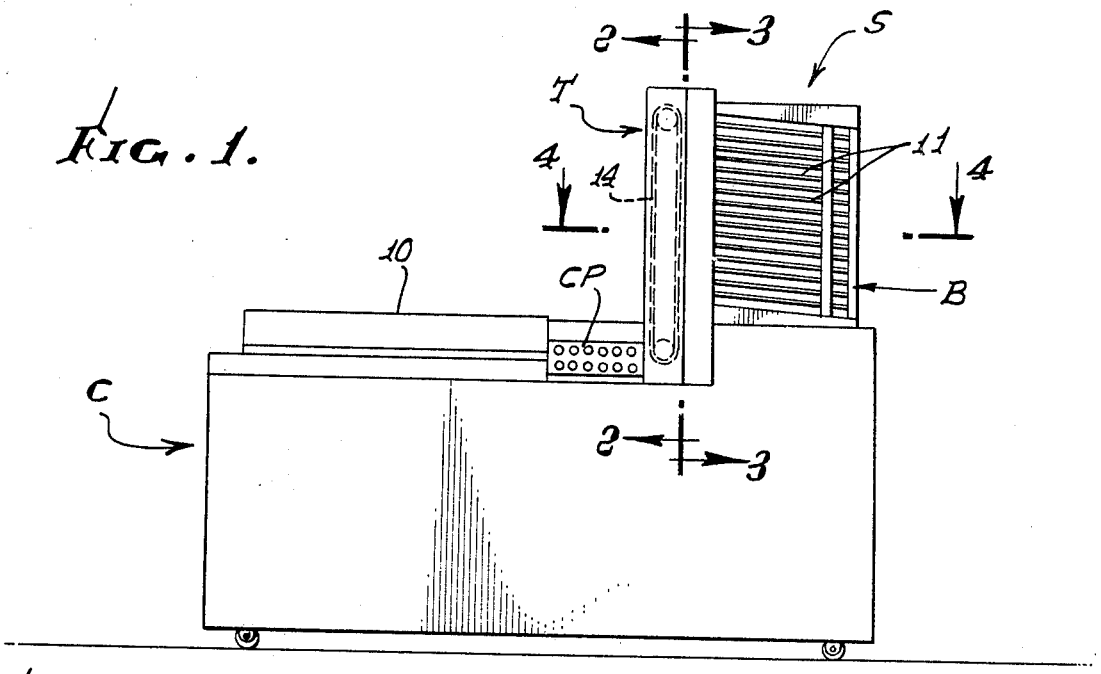
FIG. 1 is a side elevation, showing a copying machine including a sorter made in accordance with the present invention.

As seen in the drawings, a copying machine C of a desired type, has a sorter S associated therewith. Without requiring detailed illustration or description, it will be understood that the copying machine is adapted to produce one or a plurality of copies of original documents placed in the machine under the cover 10. In the sorting of plural copies into sets, successive copies are fed from the copy machine into the sorter S and directed into the trays or bins 11.

For various reasons of aesthetics and economics, it is desired that the sorter be a small and compact adjunct to the copying machine, capable of sorting sheets at high speed, as the sheets leave the copying machine in a dry, warm condition in which the sheets may tend to curl and be difficult to sort in an orderly fashion.

As seen in FIG. 1, sheets are adapted to be fed from the copying machine into the sorter between a transport section T and a bin section B, these sections being hinged together, as will be later described, so as to be openable at a meeting plane between the sections. The sheet path is between the transport and sorting sections on approximately the meeting plane, and any difficulty in the deflection of sheets by the sorting mechanism, to be hereinafter described, can ordinarily be expected to occur at this meeting plane.

Figure 2:
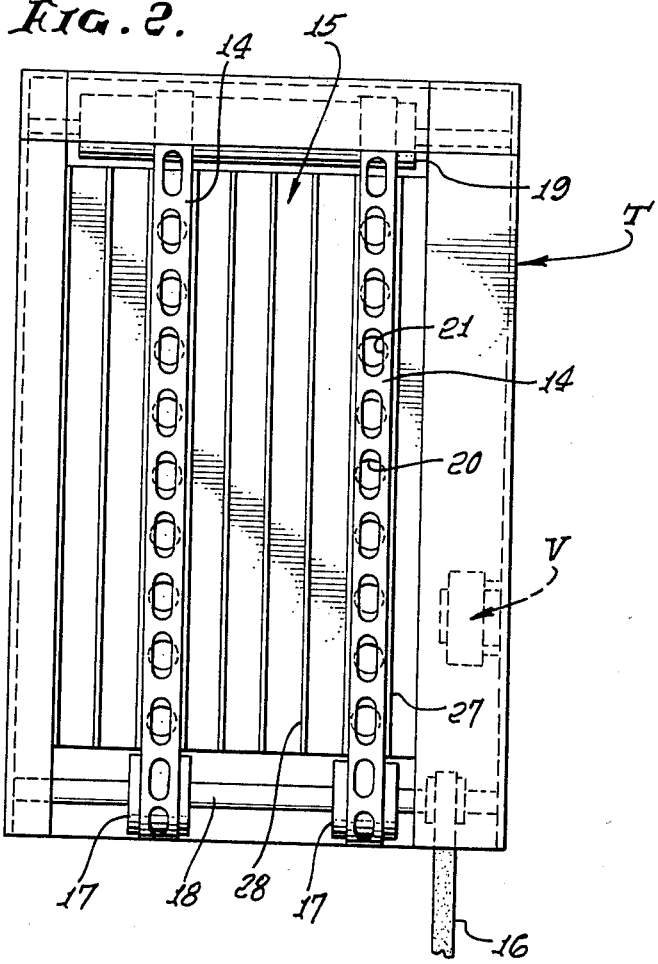
FIG. 2 is an enlarged vertical section, as taken on the line 2—2 of FIG. 1, showing the sheet transport section of the sorter.
Figure 4:
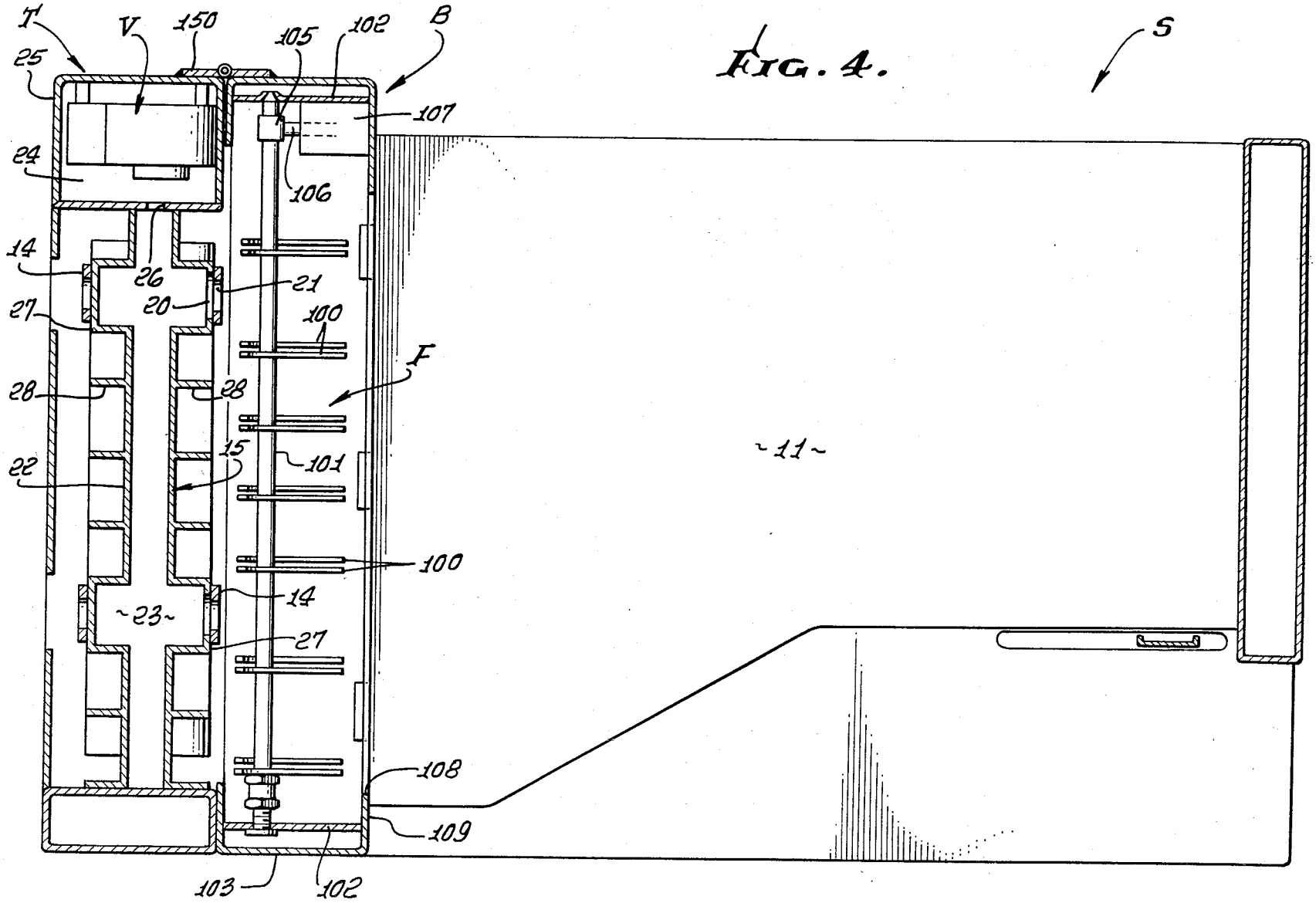
FIG. 4 is an enlarged horizontal section, as taken on the line 4—4 of FIG. 1.

The transport section T, as seen in FIGS. 2 and 4, has a number of endless belts 14 traveling about a vacuum housing 15 and driven by a drive belt 16, which can be driven by a suitable motor (not shown) located in an out-of-the-way location. The belts 14 extend about a lower set of drive rolls 17 which are rotatable with the shaft 18 driven by the motive belt 16 and the belts 14 extend about an idler shaft 19 at the upper end of the transport section, so as to travel in a vertical path, with one run of the belts 14 having its external face disposed substantially at the meeting plane of the transport and bin sections. The vacuum housing has a blower and motor assembly V mounted within an outer housing assembly and suitably supplied with a source of electricity to discharge air from the vacuum housing and cause a differential air pressure at openings 20 provided in the wall traversed by the belts, so that the successive sheets will be held on the traveling belts by the effects of the differential air pressure. The belts are perforated at suitable locations 21 so as to expose the openings in the housing wall to the opposing face of a paper sheet.

Refering to FIG. 4, it will be seen that the vacuum housing includes the inner wall 15, adjacent to the finger apparatus, and an opposing wall 22 which define therebetween a vacuum chamber or plenum 23, which communicates with another elongated chamber 24 defined in a vertically extended housing section 25 having a suitable number of ports 26 communicating with the vacuum chamber 23. The vacuum pump and motor V has its inlet in the chamber 24. Each of the walls 15 and 22 forming the vacuum chamber have laterally spaced, outwardly projecting channel-like sections 27 which define guides for the belts, and the ports 20 are in these guides and adapted to communicate with the ports in the belts, to assist in maintaining the paper sheets held closely against the belts as they traverse the pathway between the transport and the sorting section. Also spaced laterally across the walls 15 and 22 are outwardly projecting ribs 28 which terminate at or near the plane of the guide surfaces for the belt, whereby a sheet of paper, carried by the belts can not bow in the region of the ribs, but is transported by the belts in a substantially planar state, past the finger means of the sorter section, so that the successive sheets can be picked off of the belts by the finger means, as will be later described, and diverted into the respective bins or trays.

Figure 5:
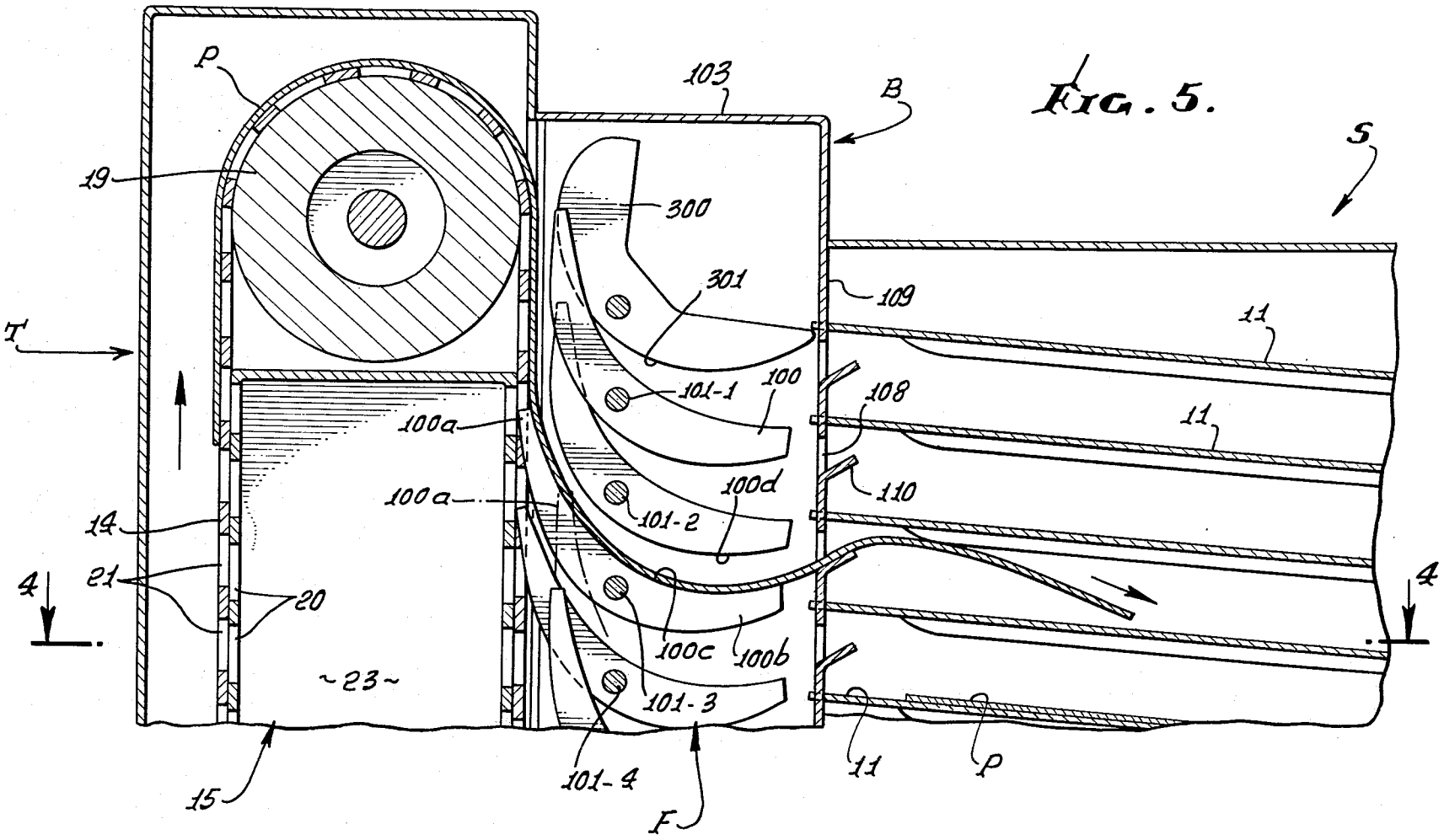
FIG. 5 is an enlarged, fragmentary vertical section, as taken on the line 5—5 of FIG. 3, showing the manner in which sheets are fed to the deflector finger mechanism and deflected into successive bins.

The finger means F comprise a plurality of sets of vertically spaced finger elements 100 fixed on rock shafts 101 which are mounted for oscillation in vertically extended suppport members 102 at opposite sides of the outer housing 103 of the bin section B. Each rock shaft 101 has a crank arm 105 connected to an armature 106 of a solenoid 107, an exemplary solenoid being shown in FIG. 4. These solenoids are adapted, as will be later discribed, to actuate the fingers 100, as shown in FIG. 5, between open and closed conditions, and in a controlled manner, whereby successive sheets are deflected from the traveling belts into successive trays or bins 11, through transversely extended openings 108 in a verically extended wall 109 of the bin section housing 103. The openings 108 in the wall 109 are formed by punching therefrom tabs or flanges 110 which extend outwardly from the wall 109 and provide an upwardly inclined surface, engageable by a sheet, as the sheet moves from the fingers into the slot 108, whereby the sheet is deflected upwardly into engagement with the undersurface of the bin or tray thereabove, and then travels into the bin in the course shown in FIG. 5.

The present invention is more particularly concerned with the manner in which the fingers 100 and rock shafts 101 are arranged and sequentially operated, whereby successive sheets are diverted from the path between the transport and bin sections into the bins.

As seen in FIG. 5, a sheet of paper (P) is being transported by the belts about the upper idler and downwardly past certain fingers which are closed, into engagement with open fingers, the open fingers deflecting the sheet from the traveling belts and directing the sheet into a bin, through the slot 108.

The fingers 100 nest in such a manner that the vertically spaced finger sets and rock shafts can be closely adjacent to one another, whereby the height of the stacker section can be minimized. Each finger 100 is generally crescent shaped and has a pickoff end **100*a* and a guide end 100*b*. Extending from the pickoff end 100*a* to the guide end 100*b*, is a smoothly arched surface 100*c* over which the sheet passes, and by which the direction of travel of the sheet is gradually changed from the downward course of travel, as the sheet leaves the belt, to the generally horizontal path of travel, as the sheet enters the tray. The undersurface 100*d* of each finger is also smoothly arched, so that a closed finger above a subjacent open finger provides an arched surface leading to the sheet receiving slot 108** of the bin, to prevent the forward or advancing edge of the sheet from curling upwardly to such an extent as to not enter the bin.

Figure 3:
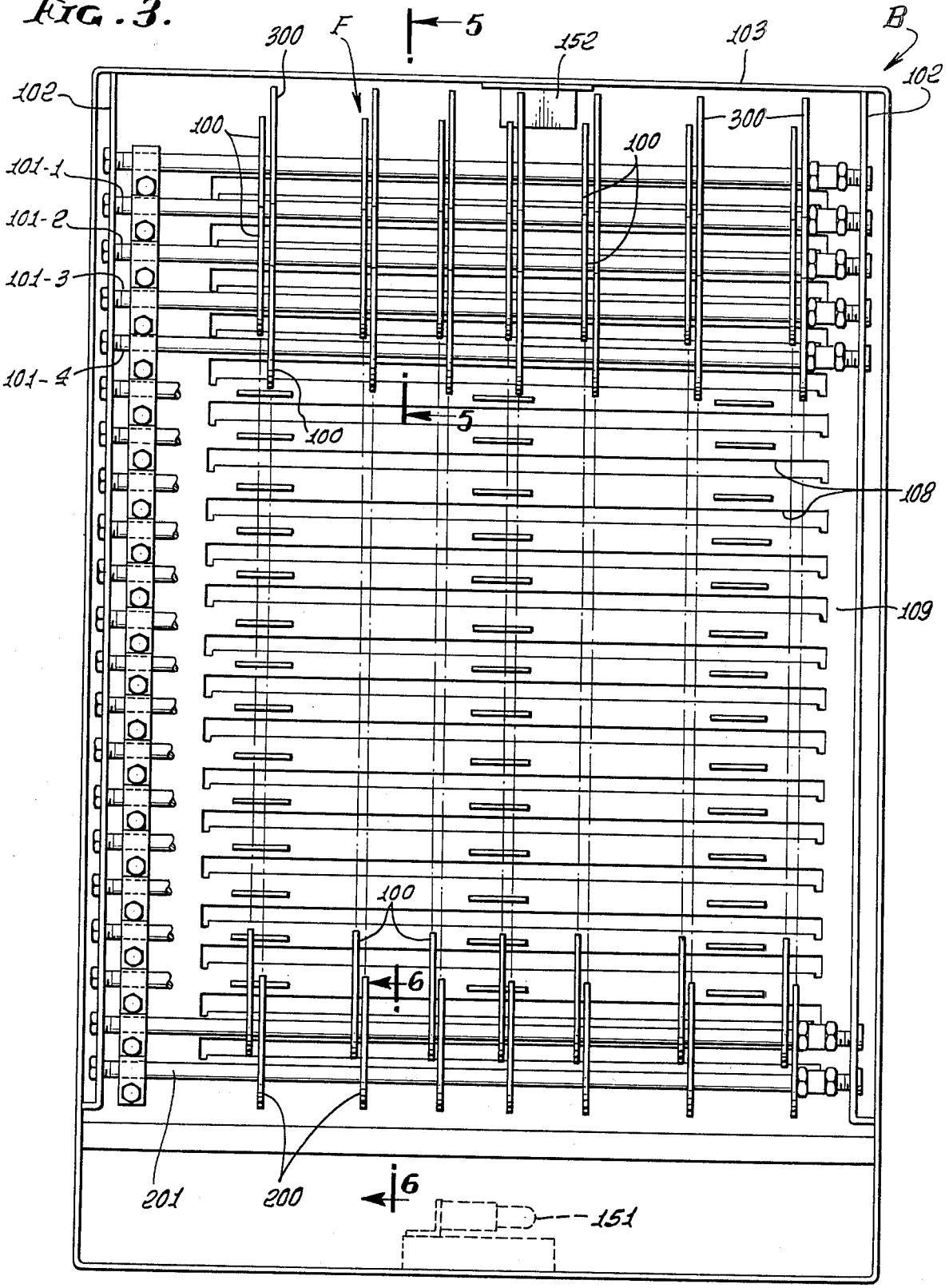
FIG. 3 is an enlarged vertical section, as taken on the line 3—3 of FIG. 1, showing the deflector finger section of the sorter.

In order to provide an arc on the surfaces **100*c* of sufficient radius to avoid an excessively sharp change in the direction of sheet travel, as the sheet traverses the fingers, the fingers must have a certain length between the extremities of the pickoff end and the guide end. Under ordinary circumstances, therefore, the fingers would normally be spaced sufficiently as to accomodate the necessary finger length. In the case of the present invention, the fingers are nested, and as seen in FIG. 5, the pickoff end 100*a* of a closed finger bridges or spans the rock shaft thereabove, and extends upwardly to approximately the region of the second rock shaft above the rock shaft on which the finger is supported. This affords substantial length for the pickoff end of the finger, whereby the necessary curvature can be provided. Such extension of the fingers is enabled by providing the fingers in a nesting pattern, as seen in FIGS. 3 and 4, wherein it can be seen that the finger 100 on the rock shaft designated 101-4 extends upwardly, bridging or spanning the rock shaft designated 101-3 so that its upper end extemity is substantially as high as the next upwardly spaced rock shaft designated 101-2**.

In addition, the finger 100 on rock shaft 101-4 is in vertical alignment with the finger 100 on the rock shaft 101-2. The finger 100 on the rock shaft 101-3, on the other hand, is in vertical alignment with the finger on the rock shaft 101-1. In other words, the fingers are made up in sets, which may be designated odd and even sets, wherein the fingers on the -1 and the -3 rock shafts are laterally spaced with respect to the fingers on the rock shafts -2 and -4, and corresponding alternate arrangements of the shafts from top to bottom of the entire finger assembly (which has been broken away in FIG. 3 for simplicity) enables a large number of the rock shafts and finger assemblies to be installed in a relatively short vertical space.

Refering to FIG. 5, it will be seen that the overlapping or nesting structure of the fingers requires that the fingers be actuated in a particular manner, so that a closed finger located below an upper finger does not interfere with the passage of the sheet over the arched surface of the open finger. In this view, the finger on rock shaft 101-4 is shown in full lines in an open position and in broken lines in a closed position. It will also be seen that with the finger on rock shaft 101-4 in the closed position the broken line upper end or deflecting end 100*a* would extend upwardly past the upper arcuate edge of the open finger on rock shaft 101-3, thereby, in the closed position, providing an obstruction which would stand in the path of the oncoming or leading edge of a sheet which has been deflected from the belts by the open finger on rock shaft 101-3. To avoid this, the finger on rock shaft 101-4 is also opened to the full line position to allow the finger on rock shaft 101-3 to properly deflect the sheet, without interference from the upper end of the subjacent finger.

Figure 6:
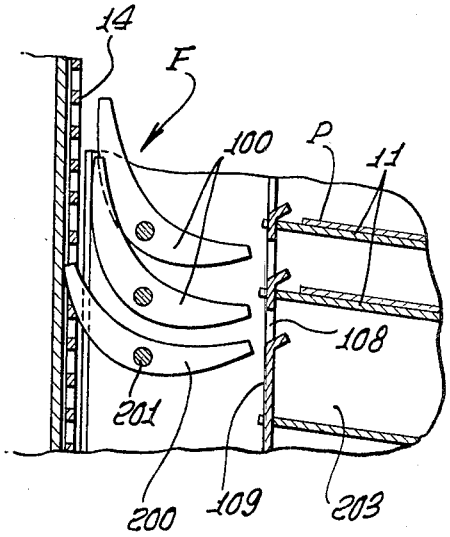
FIG. 6 is a fragmentary vertical section, as taken on the line 6—6 of FIG. 3, showing the lowermost bin arrangement.

In the operation of the sorter, the sheets are sorted from the lowermost bin to the uppermost bin. Therefore, as seen in FIG. 6, at the lower end of the spaced fingers is a fixed deflector or finger set 200 mounted upon a fixed shaft 201, these fingers and shafts preferably being constructed in the same form as those which are actuatable from closed to open position. The fingers 200 remain open at all times adjacent a lowermost bin 203, into which all sheets fed through the apparatus, when the apparatus is in a non-sorting mode, can be deflected into the bin 203. Also, above the uppermost bin is a fixed guide 300 having an arched undersurface 301 corresponding to the arched undersurface 100*d* of each of the actuatable fingers, whereby to guide a sheet deflected by the fingers on the rock shaft 101-1 into the uppermost bin of the stack.

Since in the sorting of sheets in apparatus of the type described above, any problem occurring in the transport and sorting of the sheets would generally be expected to occur in the deflection of the sheets from the traveling belts, the structure of the present invention provides a further advantage, in that, as seen in FIG. 4, the transport section T and the bin section B can be separated at the meeting plane therebetween, through which the sheet of paper travels on the belts. In the illustrated structure, the respective housings of the transport and bin sections are hingedly connected by suitable hinge means 150, whereby the entire finger and bin structure can be pivotally moved to a position exposing the fingers and exposing any sheet which may be jammed in the transport finger mechanism.

As is known, control means are provided whereby to detect the presence of a jammed sheet in the apparatus, and, as seen in FIG. 3, the present structure has a light source 151 situated at the desired location below the sorting fingers and adapted to project light upwardly through the gap between the transport and sorter section, such light being detected by a suitable sensor device 152, located above the path of sheet travel. Without requiring further illustration or description, it will be understood that any sheet being deflected by the fingers into a bin will interrupt the light between the source 151 and the sensor 152. As is known, such sheet sorting devices can be equipped with a timing device operable to turn the machine off in the event that the light remains interrupted for a period of time in excess of that necessary for a sheet to be removed from the transport and transferred into a bin. As is also well-known, such light source and sensing devices are utilized in sorting machines to cycle the deflecting devices, under the control of a suitable, manually operable control panel CP, conveniently located on the machine. The control panel CP is provided with suitable control instrumentalities enabling the selection of the sort and non-sort modes of operation, as well as the selection of the number of sets of copies to be sorted. Also, under the control of panel CP the light source and sensor 151, 152 are energized and the necessary control circuitry is rendered operative, whereby the sheets passing through the light beam, and therefore detected by the sensor, operate suitable stepping circuitry, whereby the fingers are sequentially opened and closed. The sequence of operation of the fingers as seen in FIG. 5, for example, would involve the deflection of the illustrated sheet into a bin by the open fingers on rock shaft 101-3, with the fingers on rock shaft 101-4 held in the open position. Under the control of the sensor 152, following the passage of the paper sheet into the bin, the fingers on rock shaft 101-3 are held in the open position while the fingers on rock shaft 101-4 are allowed to close, and the fingers on rock shaft 101-2 are opened. At this time the fingers on rock shafts 101-2 and 101-3 are both opened, so that the next sheet will be diverted into the next bin above.

It will be understood, without requiring detailed illustration or description herein, that various stepping circuitry can be readily provided, responsive to the sensor 152 to effect the sequential energization of the respective solenoids for the finger supporting rock shafts.

From the foregoing, it will now be apparent that the present invention provides a very compact sorter structure, due to the nesting and overlapping of the fingers, wherein the traveling sheets are confined in a relatively narrow path by the guide edges of the closed fingers and the traveling belts and ribs of the transport mechanism, but wherein, due to the extension of the length of the fingers, the radius of curvature of the deflecting surfaces of the fingers can be sufficiently large as to not cause excessive change in the direction of the sheet and potential jamming of the sheets due to their being misdirected.

I claim:

1. In a sheet sorting machine having perforated walls defining a vacuum chamber; means for discharging air from said chamber to cause air flow through said perforated walls; sheet carrying belts movable about said walls to transport sheets held thereon by air pressure; a plurality of sheet receiving trays spaced alongside said belts; and finger means actuatable between open and closed positions for picking off sucessive sheets from said belts and directing said sheets into said trays; said finger means including fingers pivotally mounted in side by side spaced and longitudinally nested relation: the improvement wherein said fingers are provided on a number of spaced pivot supports and have pick off ends extending past a next adjacent pivot support in nested relation to the pick off ends of said fingers on said adjacent pivot support to the region of the second adjacent pivot support; said fingers having sheet directing ends and an arched surface extending from the extremity of the finger pick off end to the extremity of the sheet directing ends for turning a sheet from said belts to a tray when said fingers are open; the pick off end of said fingers on any one pivot support when closed extending upstream to a location in said region of the second adjacent pivot support in interference with the feeding of a sheet over the arched surface of the next adjacent finger; actuator means for pivoting only any one pivot support and the next adjacent downstream pivot support simultaneously to open positions preventing interference between a sheet and the pick off end of the fingers of said next adjacent downstream pivot support when sheets are being deflected by said fingers on said any one pivot support.

2. In a sheet sorting machine as defined in claim 1; said fingers having another arched surface which extends substantially the length thereof and which when the finger is closed, opposes the first mentioned arched surface of an open finger spaced therefrom in the direction of sheet travel, with the opposing arched surfaces defining a continuous, arched guide path for a sheet leading to a tray.

3. In a sheet sorting machine as defined in claim 2; said pick off ends of said fingers having surfaces when closed which lie on a common plane opposed to said belts to form a flat sheet guide.

4. In a sheet sorting machine as defined in claim 1; said pick off ends of said fingers having surfaces when closed which lie on a common plane opposed to said belts to form a flat sheet guide; and guide means between said belts providing a flat sheet guide opposed to the sheet guide provided by said fingers.

5. In a sheet sorting machine as defined in claim 4; housing means mounting said fingers and said vacuum chamber, and means enabling opening of said housing means between said fingers and said belts.

6. In sheet sorting machine as defined in claim 4; a housing for said fingers and said receiver means; another housing for said vacuum chamber and said belts; and means pivotally mounting said housing for opening and closing between said fingers and said belts.

7. In a sheet sorting machine as defined in claim 1; said pivot supports including rock shafts pivotally supporting said fingers, and said actuator means including solenoid means and a crank connected with each rock shaft for opening and closing said finger means.

8. In said sheet sorting machine as defined in claim 1; said pivot supports including rock shafts pivotally supporting said fingers, and said fingers on adjacent rock shafts being differently laterally spaced, whereby said fingers nest with respect to one another.

9. In a sheet sorting machine as defined in claim 1; said pivot supports including rock shafts pivotally supporting said fingers, and said fingers on alternate rock shafts being correspondingly laterally spaced, whereby fingers on adjacent rock shafts nest with respect to one another and are aligned with fingers on the second adjacent rock shaft.

10. In a sheet sorting machine as defined in claim 1; said pivot supports including rock shafts pivotally supporting said fingers, and said fingers on alternate rock shafts being correspondingly laterally spaced, whereby fingers on adjacent rock shafts nest with respect to one another and are aligned with fingers on the second adjacent rock shaft; said fingers having another arched surface which extends substantially the length thereof and which when the finger is closed, opposes the first mentioned arched surface of an open finger spaced therefrom in the direction of sheet travel, with the opposing arched surfaces defining a continuous, arched guide path for a sheet leading to a tray.

11. In a sheet sorting machine having a sheet transport for moving successive sheets past a plurality of trays spaced alongside the transport; and finger means actuatable between open and closed positions for picking off successive sheets from said belts and directing said sheets into said trays; said finger means including fingers pivotally mounted in side by side spaced and longitudinally nested relation: the improvement wherein said fingers are provided on a number of spaced pivot supports and have pick off ends extending past a next adjacent pivot support in nested relation to the pick off ends of said fingers on said adjacent pivot support to the region of the second adjacent pivot support, said fingers having sheet directing ends and an arched surface extending from the extremity of the finger pick off ends to the extremity of the sheet directing ends for turning a sheet from said transport to a tray when said fingers are open; the pick off end of said fingers on any one pivot support when closed extending upstream to a location in said region of the second adjacent pivot support in interference with the feeding of a sheet over the arched surface of the next adjacent finger; actuator means for pivoting only any one pivot support and the next adjacent downstream pivot support simultaneously to open positions preventing interference between a sheet and the pick off end of the fingers of said next adjacent downstream pivot support when sheets are being deflected by said fingers on said any one pivot support.

12. In a sheet sorting machine as defined in claim 11; said fingers having another arched surface which extends substantially the length thereof and which when the finger is closed, opposes the first mentioned arched surface of an open finger spaced therefrom in the direction of sheet travel, with the opposing arched surfaces defining a continuous, arched guide path for a sheet leading to a tray.

13. In a sheet sorting machine as defined in claim 11, said pivot supports including rock shafts pivotally supporting said fingers, and said fingers on alternate rock shafts being correspondingly laterally spaced, whereby fingers on adjacent rock shafts nest with respect to one another and are aligned with fingers on the second adjacent rock shaft; said fingers having another arched surface which extends substantially the length thereof and which when the finger is closed, opposes the first mentioned arched surface of an open finger spaced therefrom in the direction of sheet travel, with the opposing arched surfaces defining a continuous, arched guide path for a sheet leading to a tray.

* * * * *